United States Patent [19]

Berecz

[11] 4,272,978

[45] * Jun. 16, 1981

[54] PROGRESSIVE STAGE FORGING MACHINE

[76] Inventor: Imre Berecz, 917 Acapulco St., Laguna Beach, Calif. 92651

[ * ] Notice: The portion of the term of this patent subsequent to Dec. 16, 1985, has been disclaimed.

[21] Appl. No.: 502,352

[22] Filed: Sep. 3, 1974

[51] Int. Cl.[3] ..... B21D 43/02; B21D 45/00; B21K 1/44

[52] U.S. Cl. ..... 72/335; 10/12 T; 10/13; 72/344; 72/404; 72/421; 72/427

[58] Field of Search ..... 10/13, 11 T, 12 T, 76 T, 10/72 T, 11 R, 12 R, 12.5; 72/419, 427, 447, 448, 403, 404, 335, 344, 421

[56] References Cited

U.S. PATENT DOCUMENTS

| | | | |
|---|---|---|---|
| 2,204,043 | 6/1940 | MacLagan | 10/12.5 |
| 2,303,662 | 12/1942 | Schwartz | 10/13 |
| 2,664,579 | 1/1954 | Akey | 10/13 |
| 2,747,205 | 5/1956 | Fray | 10/13 |
| 2,768,394 | 10/1956 | Ward | 10/13 |
| 3,466,917 | 9/1969 | Eakin | 10/12 T |
| 3,551,926 | 1/1971 | Ferre | 10/13 |

*Primary Examiner*—Charlie T. Moon
*Assistant Examiner*—Gene P. Crosby
*Attorney, Agent, or Firm*—Raymond L. Madsen

[57] ABSTRACT

A progressive stage forging machine is provided for forming an article in stages by means of a plurality of dies and cooperating punches, carried on a ram, wherein more than two forging blows are required to complete the forming of the article. The invention particularly provides a forging machine of the three-blow type having three punches and three cooperating dies, wherein two of the dies are carried on a member to permit alternating changes of position of those two dies, thereby eliminating a transfer mechanism between the two dies and achieving a one hundred percent increase over the production rate of presently available forging machines of the three-blow type.

9 Claims, 5 Drawing Figures

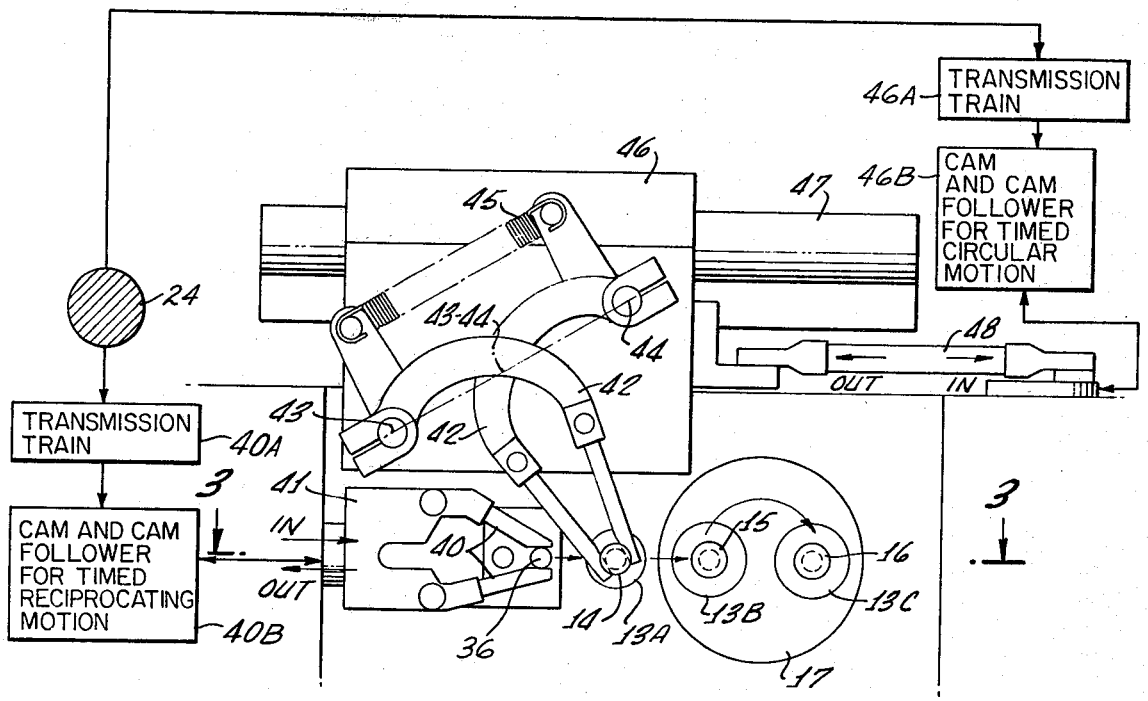
FIG. 2.
FIG. 1.
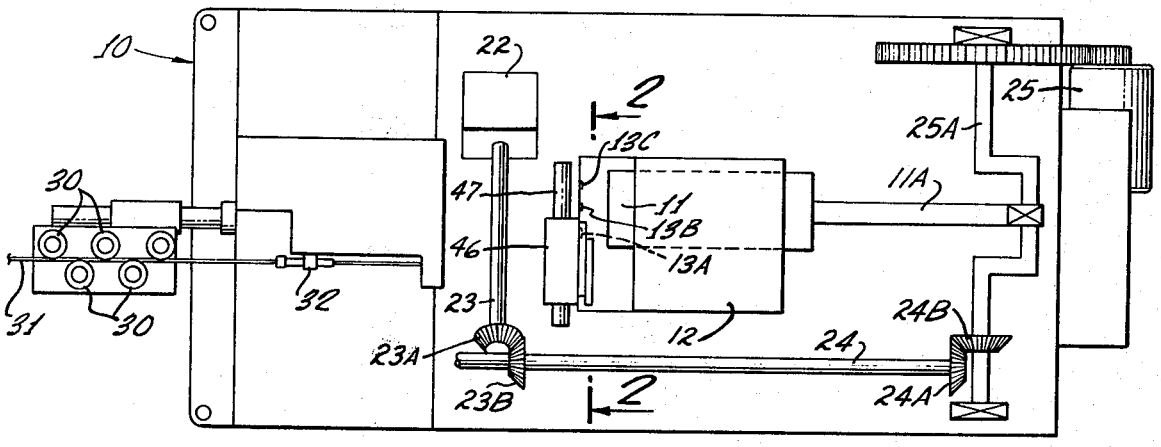

PROGRESSIVE STAGE FORGING MACHINE

FIELD OF THE INVENTION

The invention relates to a forging machine for forming an article of steel, or like material, in a plurality of dies sequentially arranged to cooperate with complementary punches, and thus permit forging of the article in progressive stages. The invention particularly relates to a 3-die, 3-punch, 3-blow cold-forging machine, wherein two of the dies are substantially identical and are mounted for alternative shifting movement between respective positions of cooperation with two of the punches.

DESCRIPTION OF THE PRIOR ART

Commercially available cold-forging machines of the 3-blow type are conventionally used in forming of bolts, or other headed articles, from work blanks of steel cut from a roll of wire stock. The slenderness ratio of that portion of the work blank to be upset during the heading operation is in the order of 3:1 (length:diameter), which limits a single stage of upsetting in multi-stage forging, or cold-forming operation. As a consequence, many headed articles require three forging blows to complete the forming of the article from a work blank of steel. This is a particular requirement in many forges of the cold-forming type.

In such commercial 3-blow forging machines, an arrangement of two dies are used in cooperation with three punches. A work blank is partially received in a first die and one blow is struck by a first punch. After transfer to the second die by suitable transfer means, the partially formed blank is struck successive second and third blows, respectively, by second and third punches, while being retained in the second die. In such machines, the two dies are mounted in stationary respective positions for cooperation with the three punches; the first die and the first punch cooperate, while the second die cooperates sequentially with the second and third punches in forming the finished article. Appropriate mechanism is provided to effect alternative shifting of the second and third punches between positions of (a) in registry with the second die and (b) out of registry with that die. Such shift mechanism may cause either reciprocating, translative movement of the second and third punches, or oscillation of such punches in an arc of movement between two positions, respectively in and out of registry with the second die.

While such forging machines produce a very satisfactory finished headed article, the number of reciprocating movements, or blows, of the power ram is twice the quantity of finished articles. For example, if a cold-heading machine operates at 600 strokes per minute, the rate of production of finished articles is obviously only 300 per minute. Accordingly, the present invention provides a cold-forging machine of the 3-blow type wherein a finished article is produced with each operating stroke of the power ram. As in the example above of a machine operating at 600 strokes per minute, the rate of production of finished articles by a forging machine embodying the present invention will be 600 per minute.

An example of a variant of the prior art described above is shown in U.S. Pat. No. 2,204,043, wherein fixed punches attached to a reciprocating power ram cooperate with two dies, which are mounted for translative movement between two positions of cooperation in registry with a selected two of the three punches. In one of such positions, the first and second punches are in registry with the dies, and in the alternate position, the dies are in registry with the second and third punches. As indicated above, the rate of production of finished articles in that type of machine is one-half the rate of power strokes, e.g., with an operating speed of 600 strokes per minute, the rate of production will be 300 finished articles per minute.

SUMMARY OF THE INVENTION

The primary objective of the invention is to provide a cold-forming machine of the 3-blow type, wherein a finished article is produced with each operating stroke of the power ram of the machine. A work blank is cut from wire stock by conventional cut-off mechanism and transferred to a first die where a first punch delivers a forging blow for partial forming of the article. A second transfer mechanism, such as conventional transfer fingers carries the partially formed article to a second die, with which a second punch cooperates and delevers a second forging blow to the work blank. Following delivery of the second blow to the blank (and in actual operation, following each stroke of the ram), shift mechanism effects a re-positioning, or indexing, of the second and third dies to positions respectively in registry and in cooperation with the third punch and the second punch; the semi-finished blank is retained in the second die during such re-positioning. The third, and finishing, blow is then struck, causing the third punch to enter the second (as previously designated) die and finish the article. Following the third blow, the shift mechanism for the second and third dies then re-positions such dies to their respective former positions in registry, respectively, with the second and third punches.

Appropriate ejector, or knock-out pins are provided in the second and third dies for removal of the finished article following the delivery of the finishing (third) blow by the third punch. Conventional timed operator mechanism, such as a cam and follower, is provided for effecting such removal in timed relation to the completion of the finishing blow. Although both the second and third dies are provided with respective ejector pins, the timed operator mechanism acts only upon that die in registry with the finishing (third) punch.

The construction of such a forging machine can double the rate of production of presently available machines of the cold-forming type, while operating at the same rate of strokes of the power ram. Additional advantages of shifting of the second and third dies is (a) in a progressive type of heading machine, the elimination of transfer of the semi-finished blank (following the second blow) to the finishing die for the third blow; and (b) ejection, or knock-out, of the finished article from the last die while the die is in a position out of registry with any punch. The latter advantage is particularly desireable in forming articles from relatively long work blanks, since it permits an operational speed at the same rate as when shorter blanks are being formed into finished articles. This result is achieved by appropriate timing mechanism (described below), which shifts that die carrying the finished article out of registry with the third punch and permits commencement of the knock-out operation at an earlier point in the complete operational cycle of each successive blow. This is graphically illustrated in the timing chart also described below. By knocking out the finished article while the finishing die is out of registry with its cooperating punch, interference between that article and the punch is avoided in high speed operation producing relatively long articles.

BRIEF DESCRIPTION OF THE DRAWINGS

FIG. 1 is a top plan view of a forging machine embodying the invention.

FIG. 2 is a view in partial vertical transverse section, partly in block diagram of the machine of FIG. 1, taken on line 2—2 thereof, and illustrating the tandem arrangement of the two sets of transfer fingers and the arrangement of the three dies.

Referring more specifically to the drawings, a forging machine embodying the invention is generally illustrated in FIG. 1 as having a longitudinally extended frame 10 in which a power ram 11 is supported in a guide 12 for reciprocating longitudinal movement relative to a plurality of dies (described below) and located at three die stations designated by the items 13A, 13B, and 13C. The die stations are more clearly shown in FIG. 2, in which 13A represents a first die station wherein a die 14, of an extrusion type, is mounted in the frame, and 13B and 13C represent second and third die stations containing identical dies 15 and 16, respectively. The second station is a coning, or semi-finishing station, and the third is a finishing station in the forging machine illustrated. As illustrated in FIG. 2, identical dies 15 and 16 are carried in a cylindrical indexing member 17. Power Ram 11 is connected by a shaft 11A to a crankshaft 25A which in turn is coupled to a main motor or power source 25.

Figure 3:
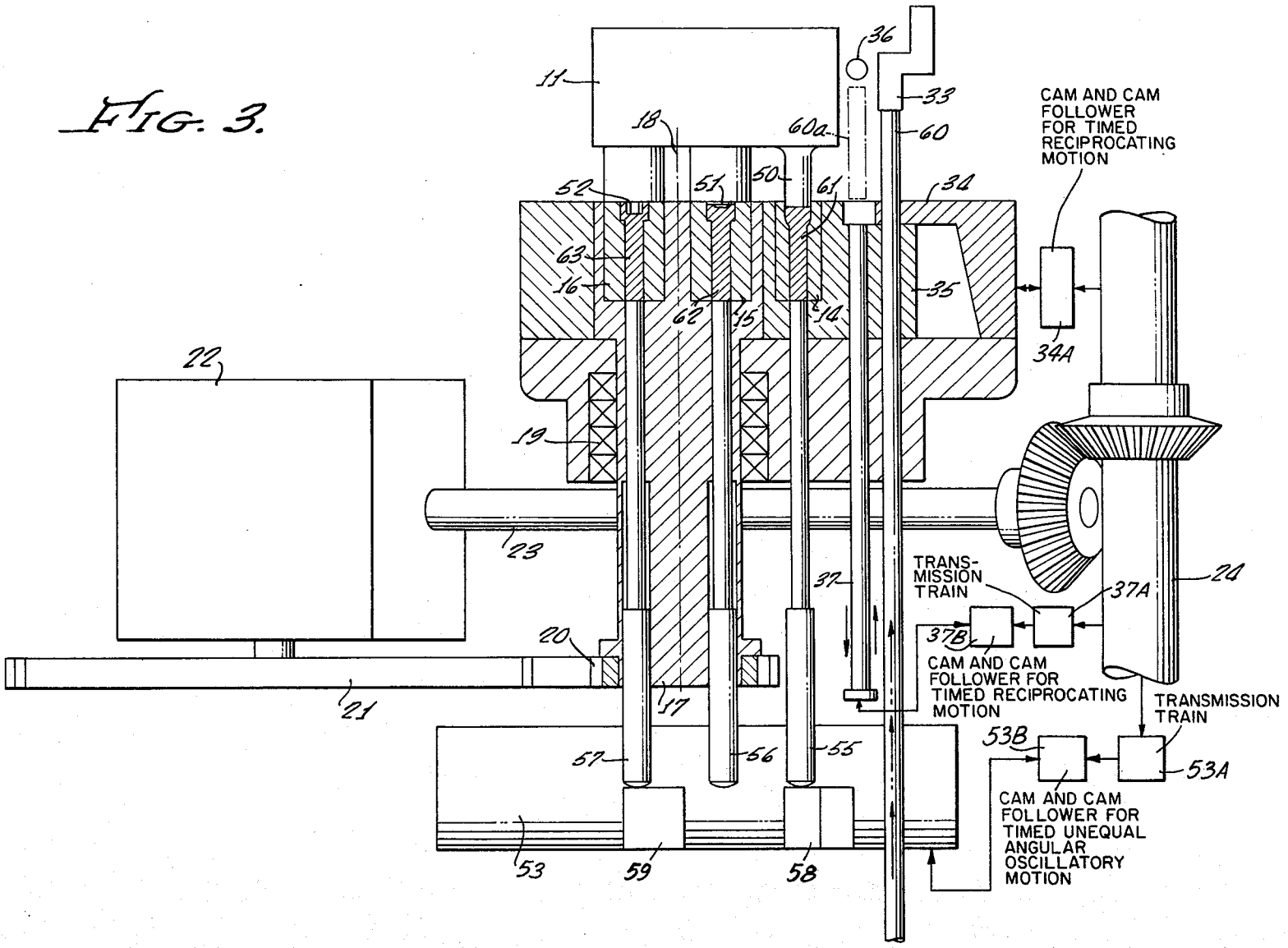
FIG. 3 is a fragmentary, somewhat enlarged view in partial horizontal longitudinal section, partly in block diagram of the machine of FIG. 1 taken in a plane indicated by line 3—3 of FIG. 2, a portion of the indexing and timing mechanism being fragmentarily illustrated, the power ram being in an engaged position relative to the dies.

The die stations 13A, 13B, and 13C are arranged in the frame in transversely aligned operational positions relative to the forging stroke of ram 11. Die 14 is mounted in a fixed position, while dies 15 and 16 are carried in the cylindrical indexing member 17 for alternate shifting between the second and third stations. The cylindrical member 17 is mounted in the frame for rotation and/or circumferential oscillation about a longitudinal axis 18, as illustrated in FIG. 3, which is parallel to the reciprocal path of travel of ram 11. A bearing 19 (FIG. 3) permits rotation and/or oscillation about axis 18. A ring gear 20 is non-rotably secured to member 17.

To effect desired movement of indexing member 17, a timing gear 21 meshes with ring gear 20, and is actuated by a timing mechanism 22 (the details of which are not shown), powered through transmission shaft 23, which is operably connected by a drive shaft 24 to a crankshaft 25A and to a main motor 25 (FIG. 1) serving as a source of power. In the embodiment of the invention illustrated, the indexing cylinder is rotated through an arc of 180° at timed intervals in relation to movement of the ram 11. The timing mechanism 22 may include a Geneva cam, or other suitable devices, such as an indexing mechanism containing a cam having a concave globoidal shape and a tapered rib with a number or radially mounted cam followers manufactured by Ferguson Machine Company, St. Louis, Missouri, to achieve the desired degrees of dwell (as measured by the conventional main crankshaft 25A employed to effect reciprocal movement of ram 11) while in indexed position. One of the two possible indexed positions is shown in FIG. 2; the other of such positions is 180° from that so shown.

As illustrated in FIG. 1, a plurality of guide rollers are mounted on the frame and arranged to straighten wire stock 31, normally supplied in coiled form (not shown). A feeder 32, is operated at timed intervals by conventional cam and follower mechanism (not shown), to effect incremented linear advances of the wire stock toward a stop 33. As shown more clearly in FIG. 3, the stop is spaced from a shearing blade type of cutter 34 cooperating with a feeding guide 35 to define a cutting station; the stop is adjusted in position to limit the lenght of stock, in conformity with the volume of the dies 13A, 13B, 13C. The cutter blade is moved by a cam and cam follower 34A connected to drive shaft 24 and constructed for timed reciprocating motion through a range of travel to deliver the cut portion to a pick-up station aligned with pusher bar 37, which is arranged for reciprocal movement parallel to ram 11 through a cam and cam follower 37B for providing timed reciprocating motion which is connected through a transmission train 37A to drive shaft 24.

Referring to FIG. 2, a first pair of transfer fingers 40 are individually pivotally mounted on a carrier 41 in opposed, cooperating relation to grasp a portion of the wire stock after being severed by the cutter 34. The carrier is mounted on the machine frame 10 in a manner to permit reciprocation in a path of travel transverse to the ram direction; the power mechanism for effecting such reciprocation is a cam and cam follower for reciprocating motion 40B connected to drive shaft 24 by a transmission train 40A whereby the range of travel of transfer fingers 40 is from the pick-up station 36 (FIG. 3) to a position longitudinally aligned with the first station die 13A. A second pair of transfer fingers are individually mounted on respective pivots 43, 44 and urged to a closed position by means of biasing spring 45. The pivots are mounted on a carrier 46 and arranged so that an imaginary line 43–44 passing through the pivot centers is obliquely angularly related to the path of travel of carrier 46 slidably mounted on a support bar for reciprocal movement between the first station die 13A and the second station die 13B. A drag link 48 is connected to a suitable conventional power transmission mechanism in the form of a cam and cam follower 46B for timed circular motion coupled by transmission train 46A to drive shaft 24 to effect such reciprocal movement in timed relation to reciprocation of ram 11 and synchronized movements of other components described below.

Figure 4:
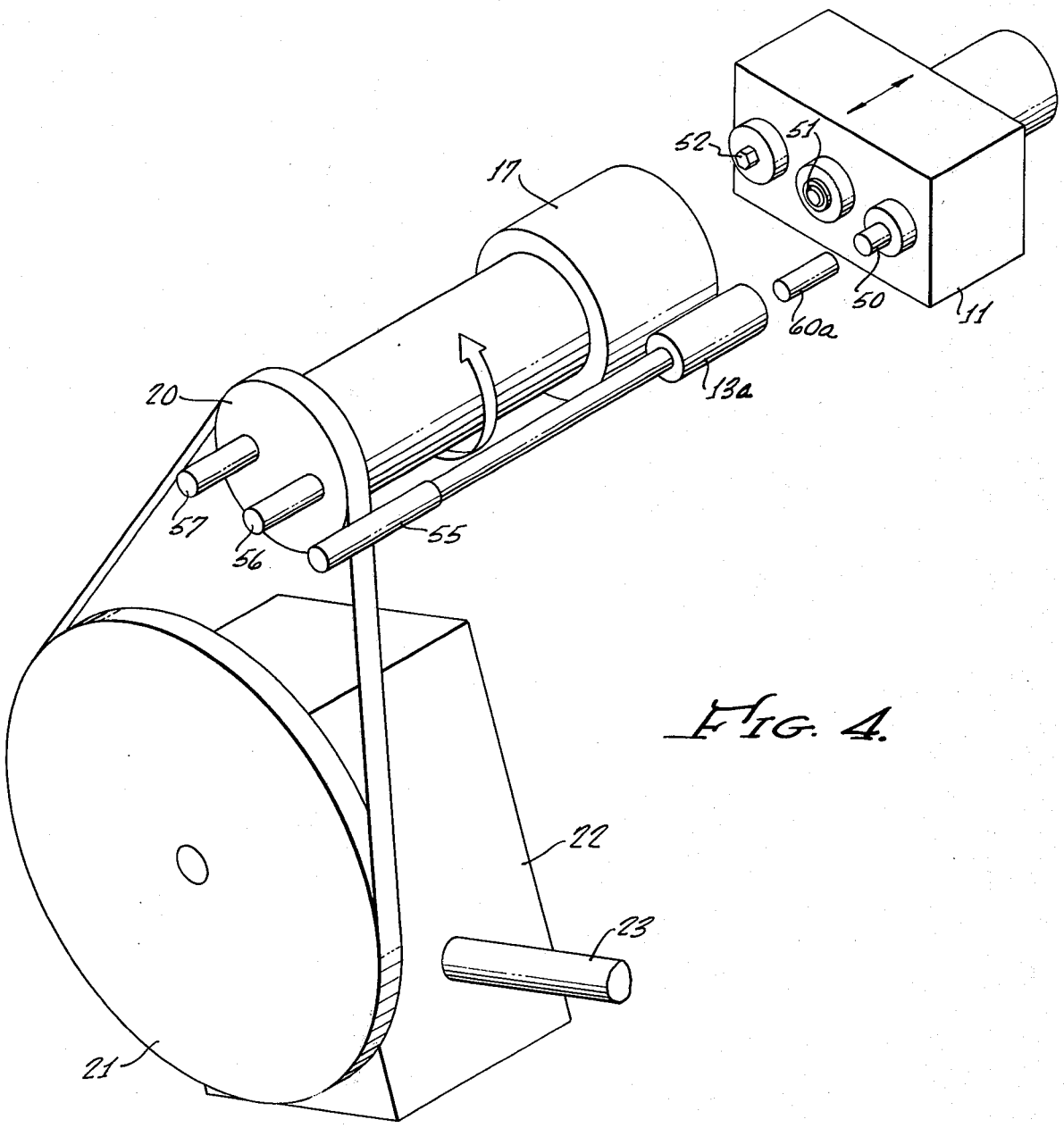
FIG. 4 is a fragmentary isometric view of the three dies and cooperating punches of FIG. 3, the supporting portions of the machine frame not being shown for purposes of clarity.

As illustrated in FIGS. 3 and 4, a plurality of punches 50, 51, 52 are rigidly carried by the ram in positions transversly aligned relative to ram movement. The configuration of each punch is selected depending upon the design of the dies, the desired finished article, the ductility of stock and other variables considered in conventional tooling practices. In the embodiment illustrated the first punch 50, cooperates with die 13A of the extrusion type; the second punch 51 is a coning punch and cooperates with the die in the second station; and the third punch 52 is a finishing punch, which cooperates with the die in the third station. It is to be noted that each of the punches 51 and 52 cooperate alternately with dies 13B and 13C, since each die is rotated in an 180° arc of travel to the respective position of the other after each power stroke of the ram.

As may also be seen in FIGS. 3 and 4, a first ejector, or knock-out pin 55 is mounted in the frame for reciprocal movement to eject a workpiece blank from die 13A. In similar arrangement, second and third ejector, or knock-out pins 56, 57 are carried in suitable bores in the cylindrical indexing member 17 to eject the finished article from the die then in the third station. As shown in FIG. 3, ejector operating arms 58, and 59 connected to shaft 53 are provided to actuate the first ejector 55, and either the second 56 or third 57, depending on which is in a position of alignment with arm 59 while in the third station. A cam and cam follower 53B provides timed and unequal angular oscillatory motion to shaft 53 to move arms 58 and 59 in a manner which will be discussed hereinafter. Cam and cam follower 53B is connected to drive shaft 24 by transmission train 53A. An ejector is not provided for the second station die, since the work piece is retained in that die as the die is moved to the third station upon 180° of rotational movement of indexing member 17. In FIG. 3, a work piece blank 60 is shown in a position at commencement of shearing from the wire stock 31; at the termination of cutter movement, the blank 60 has been carried to the position shown in dashed lines, **60*a*. The numerals 61, 62 and 63**, respectively designates such a work piece blank as it progressively moves through the first, second and third station dies.

OPERATION

Figure 5:
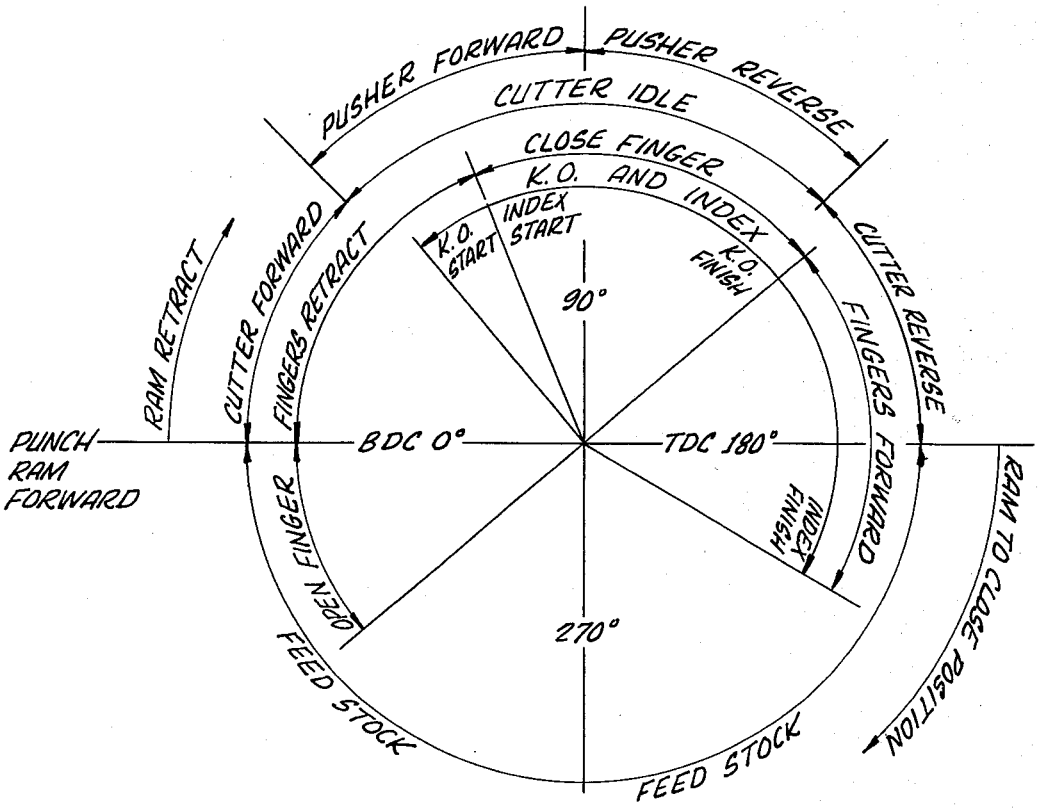
FIG. 5 is a timing chart showing relative positions of the main crank as sequential operations occur through appropriate power transmission and conventional timing mechanisms, such as cam and cam follower assemblies, to achieve the separate sequential operations of cutting a workpiece blank from the wire stock, transferring the blank by a first set of fingers to a position of longitudinal alignment with the cavity of a first die, release of the blank and retraction of the fingers during concurrent extension of the power ram and the punches carried thereon. The chart also shows movement of a second set of fingers used in transferring the blank from the first die to a die at a second die station for forming by a second punch, and shifting of that same die to a third die station, while carrying the blank for a finishing forging blow by a third punch.

A supply of material stock 31 is fed to the cutter 34 by timed operation of feeder 32. The graphic illustration of feeder operation is shown in the Timing Chart of FIG. 5, wherein the sequential steps occur as follows: (1) feed stock; (2) open fingers; (3) cutter forward to shear a workpiece blank from the stock; (4) pusher forward to align the blank transversely with the first set of fingers; (5) close fingers; (6) fingers forward to effect transverse movement in transferring a blank from the cutting station to the first die station (simultaneously, the second set of fingers 42 is transferring a partially finished blank from the first die station to the second die station); (7) simultaneously at commencement of finger closing, the cylindrical indexing member is actuated by the timed power transmission means comprising items 24, 23, 22, 21 and 20 to rotate 180 degrees, and thereby shift the positions of dies 15 and 16 between die stations 13B and 13C; (8) forward movement of the power ram commences prior to complete indexing of dies 15 and 16 to minimize cycle time; the ram moves forward through 180 degrees of crankshaft movement to a position marked B.D.C. (Bottom Dead Center), to deliver a forging blow to each of the workpiece blanks in die stations 13A, 13B, and 13C; (9) the ram commences retraction after the crankshaft passes Bottom Dead Center, and ejection of the workpiece blanks in dies of stations 13A and 13C is initiated after about 45 degrees of crankshaft rotation; initiation of ejection is effected by the timed operator means comprising items 24, 53A, 53B, 53, 58 and 59 acting upon the ejector knock-out pin provided in each of the dies, and full ejection is delayed by first imparting a smaller angular movement of shaft 53 and then a larger angular movement by the timed unequal angular oscillatory motion of cam and cam follower 53B until after indexing of the dies in stations 13B and 13C has commenced. This arrangement permits an earlier full ejection of the blanks without waiting for the ram (and punches) to retreat (during retraction) ahead of the blank being ejected. The sequence is then repeated through each 360 degrees of crankshaft rotation, and the respective movements indicated by the legends shown on the Timing Chart of FIG. 5 occur in repeated sequences. Accordingly, a workpiece blank travels by the first set of fingers from cutting station to the first die station 13A to receive a first forging blow, is then ejected and transferred by the second set of fingers to the die then indexed at the second die station 13B to receive a second forging blow, and is then retained in that die as the cylindrical indexing member is rotated 180 degrees to thereby position that same die (in which the blank is retained) at the third die station 13C to receive a third, and finishing blow, upon the next extension of the ram. After that blow is struck, the finished article is ejected. Simultaneously, the dies at the first and second stations are each receiving a respective blank upon each extension of the ram. By utilising the present invention, a finished part is produced upon each blow of the ram, and the production rate of contemporary machines is thereby doubled.

I claim:

1. A progressive stage forging machine for forming articles of steel and like material from work piece blanks cut from material stock, said machine comprising:

(a) a frame;

(b) a source of power;

(c) a power ram mounted in the frame for reciprocating movement along a rectilinear path of travel between an extended position and a retracted position;

(d) first power transmission means, including a main crankshaft, interconnecting the power source and the ram for powered reciprocal movement along said path of travel;

(e) first, second, and third punches carried at the distal end of the ram and arranged at intervals of spacing transversely related to the path of travel of the ram;

(f) first, second, and third dies carried by the frame and arranged at first, second, and third die stations spaced transversely of said path, the dies being in individual positions of cooperation aligned respectively with one of said punches;

(g) means mounting the first of said dies in a fixed aligned position relative to the first of said punches;

(h) indexing means carried by the frame and mounting each of the remaining two of said dies for alternative shifting of the second die and the third die between positions alternatively, respectively aligned with the second punch and the third punch;

(i) transfer means to feed an individual work piece blank to the first die station;

(j) separate transfer means to effect transfer of an individual blank from the first die station to the second die station;

(k) second power transmission means, including timing mechanism, connected between the main crankshaft and both of said transfer means to effect timed transfer of the blanks respectively held thereby, the transfer occurring prior to a predetermined extended position of the ram and a corresponding position of rotation of the crankshaft; and (l) third power transmission means, including timing mechanism connected between the main crankshaft and said indexing means to effect shifting of the second die and the third die between positions alternatively, respectively aligned with the second punch and the third punch, such shifting commencing after each stroke of the ram to an extended position and being completed within a predetermined arc of rotation of the crankshaft, so that upon successive extensions of the ram, the third punch delivers a finishing blow to a work piece blank on each such extension, the first finishing blow being delivered to a blank carried in one of either the second die or the third die, and the next blow being delivered to a blank carried in the other of such dies.

2. The machine of claim 1 wherein ejector means is provided in each of the dies in opposed relation to said punches, wherein operator means is arranged in relation to only those dies located in the first and third stations and wherein timed power transmission means is operably connected between the main crankshaft and the operator means to effect actuation thereof at a predetermined point in the path of travel of the ram following full extension thereof.

3. The machine of claim 2 wherein the power transmission means for the die indexing means and the timed power transmission for the ejector operator means are coordinated to effect initial ejection of each work piece from the dies located at the first and third stations at a point in the operating path of travel immediately after initial retraction of the ram and to delay full ejection of such workpieces only after the second and third dies have been shifted by the indexing means to respective positions out of alignment with the second and third die.

4. The machine of claim 2 wherein cutter means are provided in the frame to afford a cutting station and to effect severance of an individual work piece blank from the material stock and wherein power transmission means are connected between the source of power and said cutter means to effect operation of the cutter means in timed relation to the ram and the transfer means to feed a work piece to the first die station.

5. The machine of claim 1 wherein said indexing means comprises a cylindrical member mounted in the frame for rotation about an axis parallel to the path of travel of the ram and wherein said second and third dies are carried on the cylindrical member.

6. A progressive stage forging machine for forming articles of steel from work piece blanks cut from elongated material stock, said machine comprising:

(a) a frame;

(b) a source of power mounted in the frame;

(c) cutter means arranged in the frame at a cutting station and driven by the source of power to effect severance of an individual work piece blank from the material stock;

(d) a power ram mounted in the frame for reciprocating movement along a rectilinear path of travel between an extended position and a retracted position;

(e) first power transmission means, including a main crankshaft, interconnecting the power source and the ram for powered reciprocal movement along said path of travel;

(f) first, second, and third punches carried at the distal end of the ram and arranged at intervals of spacing transversely related to the path of travel of the ram;

(g) first, second, and third dies carried by the frame and arranged at first, second, and third die stations spaced transversely of said path, the dies being in individual positions of cooperation aligned respectively with one of said punches;

(h) means mounting the first die in a fixed, rigid position relative to the first punch;

(i) a cylindrical indexing member having a longitudinal axis parallel to said ram path of travel and carrying each of the remaining two of said dies;

(j) bearing means mounting the indexing member for rotation about said axis to permit alternative shifting of the second die and third die between positions alternatively, respectively aligned with the second punch and the third punch;

(k) transfer means to feed an individual work piece blank to the first die station;

(l) separate transfer means to effect transfer of an individual blank from the first die station to the second die station;

(m) second power transmission means, including timing mechanism, connected between the main crankshaft and both of said transfer means to effect timed transfer of the blanks respectively held thereby, the transfer occurring prior to a predetermined extended position of the ram and a corresponding position of rotation of the crankshaft; and (n) third power transmission means, including timing mechanism connected between the main crankshaft and the cylindrical indexing member to effect cyclic rotation thereof in increments of 180 degrees, each indexing cycle commencing after each stroke of the ram to an extended position and being completed within a predetermined arc of rotation of the crankshaft, so that upon any two successive extensions of the ram, the third punch delivers a finishing blow to a work piece blank on each such extension, the first of such extensions causing a finishing blow to be delivered to a blank carried in one of either the second die or the third die, and following completion of an indexing cycle, the next ram extension causing a finishing blow to be delivered to a blank carried in the other of such dies, thereby producing a finished article upon each successive extension of the ram.

7. The machine of claim 6 wherein a knock-out type of ejector pin is provided in each of the dies and arranged in longitudinally opposed relation to said punches, wherein operator means is arranged in relation to only those dies located in the first and third die stations, and wherein timed power transmission means is operably connected between the main crankshaft and the operator means to effect actuation thereof at a predetermined point in the path of travel of the ram following full extension thereof.

8. The machine of claim 7 wherein the power transmission means for the cylindrical die indexing member and the timed power transmission for the ejector pin operator means are coordinated to effect initial ejection of each work piece from the dies located at the first and third stations at a point in the operating path of travel immediately after initial retraction of the ram and to delay full ejection of such workpieces only after the second and third dies have been shifted by the indexing means to respective positions out of alignment with the second and third die.

9. The machine of claim 8 wherein cutter means are provided in the frame to afford a cutting station and to effect severance of an individual work piece blank from the material stock and wherein power transmission means are connected between the source of power and said cutter means to effect operation of the cutter means in timed relation to the ram and the transfer means to feed a work piece to the first die station.

* * * * *